US007986111B2

(12) United States Patent
Bakre et al.

(10) Patent No.: US 7,986,111 B2
(45) Date of Patent: Jul. 26, 2011

(54) ELECTRONIC BALLAST CONTROL CIRCUIT

(75) Inventors: Shashank Bakre, Woburn, MA (US); Nitin Kumar, Burlington, MA (US)

(73) Assignee: Osram Sylvania Inc., Danvers, MA (US)

( * ) Notice: Subject to any disclaimer, the term of this patent is extended or adjusted under 35 U.S.C. 154(b) by 309 days.

(21) Appl. No.: 12/474,049

(22) Filed: May 28, 2009

(65) Prior Publication Data

US 2010/0301754 A1 Dec. 2, 2010

(51) Int. Cl.
*H05B 37/02* (2006.01)

(52) U.S. Cl. ..... 315/308; 315/224; 315/247

(58) Field of Classification Search ..... 315/224, 315/225, 247, 291, 294, 307–309
See application file for complete search history.

(56) References Cited

U.S. PATENT DOCUMENTS 5,751,115 A * 5/1998 Jayaraman et al. ..... 315/225
6,326,740 B1 * 12/2001 Chang et al. ..... 315/291
7,042,170 B2 * 5/2006 Vakil et al. ..... 315/291
7,239,091 B2 * 7/2007 Shinmen et al. ..... 315/224
7,391,163 B2 * 6/2008 Jang ..... 315/219
2006/0170372 A1 8/2006 Heckmann et al.
2006/0197466 A1 * 9/2006 Park ..... 315/224
2006/0232224 A1 10/2006 Heckmann et al.

* cited by examiner

*Primary Examiner* — Douglas W Owens
*Assistant Examiner* — Amy Yang
(74) *Attorney, Agent, or Firm* — Shaun P. Montana

(57) ABSTRACT

A control circuit for use in a ballast configured for powering a first lamp set and a second lamp set. The second lamp set is operated via a controller and a second lamp driver circuit. The controller enables the second lamp driver circuit as a function of a monitored value corresponding to a current through a lamp of the second lamp set. The control circuit includes first and second input terminals for selectively connecting to the power supply. The control circuit reduces the monitored value as a function of a connection state of the first and second input terminals of the control circuit to the power supply. Thus, the control circuit causes the controller to selectively operate the second lamp driver circuit in order to energize the second lamp set in combination with the first lamp set.

18 Claims, 7 Drawing Sheets

ELECTRONIC BALLAST CONTROL CIRCUIT

CROSS-REFERENCE TO RELATED APPLICATIONS

Co-invented and co-owned U.S. patent application Ser. No. 12/474,080, filed simultaneously herewith, entitled "Resetting an Electronic Ballast in the Event of Fault," is incorporated herein by reference in its entirety. In addition, co-invented and co-owned U.S. patent application Ser. No. 12/474,141, filed simultaneously herewith, entitled "Relamping Circuit for Dual Lamp Electronic Ballast," is incorporated herein by reference in its entirety.

FIELD OF THE INVENTION

The present invention generally relates to electronic ballasts for providing power to multiple lamp sets. More particularly, the invention is directed to a control circuit for selectively operating a second lamp set in combination with a first lamp set.

BACKGROUND OF THE INVENTION

Multiple level lighting systems, such as two level lighting systems, are used in various different lighting applications. For example, two level lighting systems are commonly used in overhead lighting. Such lighting systems can be used to conserve energy since they allow a portion of the lighting to be turned off when full light is not necessary.

A typical implementation of a two level lighting system includes two power switches and two ballasts, wherein each power switch in the lighting system controls only one of the ballasts in the lighting system. Turning on both of the switches at the same time powers both ballasts, thus producing full light output from the lighting system. Turning on only one of the switches applies power to only one of the ballasts in the lighting system and thus results in a reduced light level and a corresponding reduction in power consumed.

However, it is more economical to have a single ballast in the lighting system rather than two ballasts. One implementation of a two level lighting system using only a single ballast has a switch corresponding to each lamp set. Thus, this implementation requires two switches.

In an alternative implementation of a two level lighting system having a single ballast, the ballast includes two controllers, each of which controls a lamp set. In order to shut off one lamp set, the supply voltage to the controller corresponding to the one lamp set is pulled down (e.g., grounded) so that the controller is disabled. However, this implementation is not energy efficient because even though a controller is disabled, the supply voltage for that controller is still being pulled from the power supply.

SUMMARY OF THE INVENTION

Embodiments of the present invention provide a multiple level lighting system using a single ballast. In particular, embodiments are directed to a control circuit for use in a ballast configured to energize two lamp sets, a first lamp set and a second lamp set. The first lamp set is operated via a first controller and a first lamp driver circuit connected to the first controller. The second lamp set is operated via a second controller and a second lamp driver circuit connected to the second controller. The control circuit is connected to the second controller for selectively operating the second lamp driver circuit in order to energize the second lamp set while the first lamp set is energized.

The second controller, among other things, monitors a first value and a second value, compares the first value and the second value, and makes decisions based on the results of comparisons of the first value and the second value. The first value corresponds to a current (i.e., a first current) through a lamp filament of the second lamp set. The second value corresponds to a reference current (i.e., a second current). The second controller determines a ratio of the first value to the second value. When the second controller determines that the ratio of the first value to the second value is less than or equal to a predetermined ratio, then the second controller disables the second lamp driver circuit. When the second controller determines that the ratio is greater than the predetermined ratio, then the second controller enables the second lamp driver circuit. The second controller restarts the ballast in response to the ratio transitioning from below the predetermined ratio to equal to or above the predetermined ratio.

The control circuit includes a first input terminal and a second input terminal. The first input terminal is connected to ground. The control circuit reduces the first current as a function of a voltage state (e.g., positive or non-positive) between the first and second input terminals. In one embodiment, the second input terminal is adapted for connecting to a positive terminal (e.g., high voltage terminal, neutral terminal) of a power supply for the ballast. Accordingly, the control circuit reduces the first current as a function of the connection state of the second input terminal to the positive terminal of the power supply. Thus, the second lamp driver circuit is enabled, and the second lamp set is energized, as a function of the connection state of the second input terminal of the control circuit to the positive terminal of the power supply.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
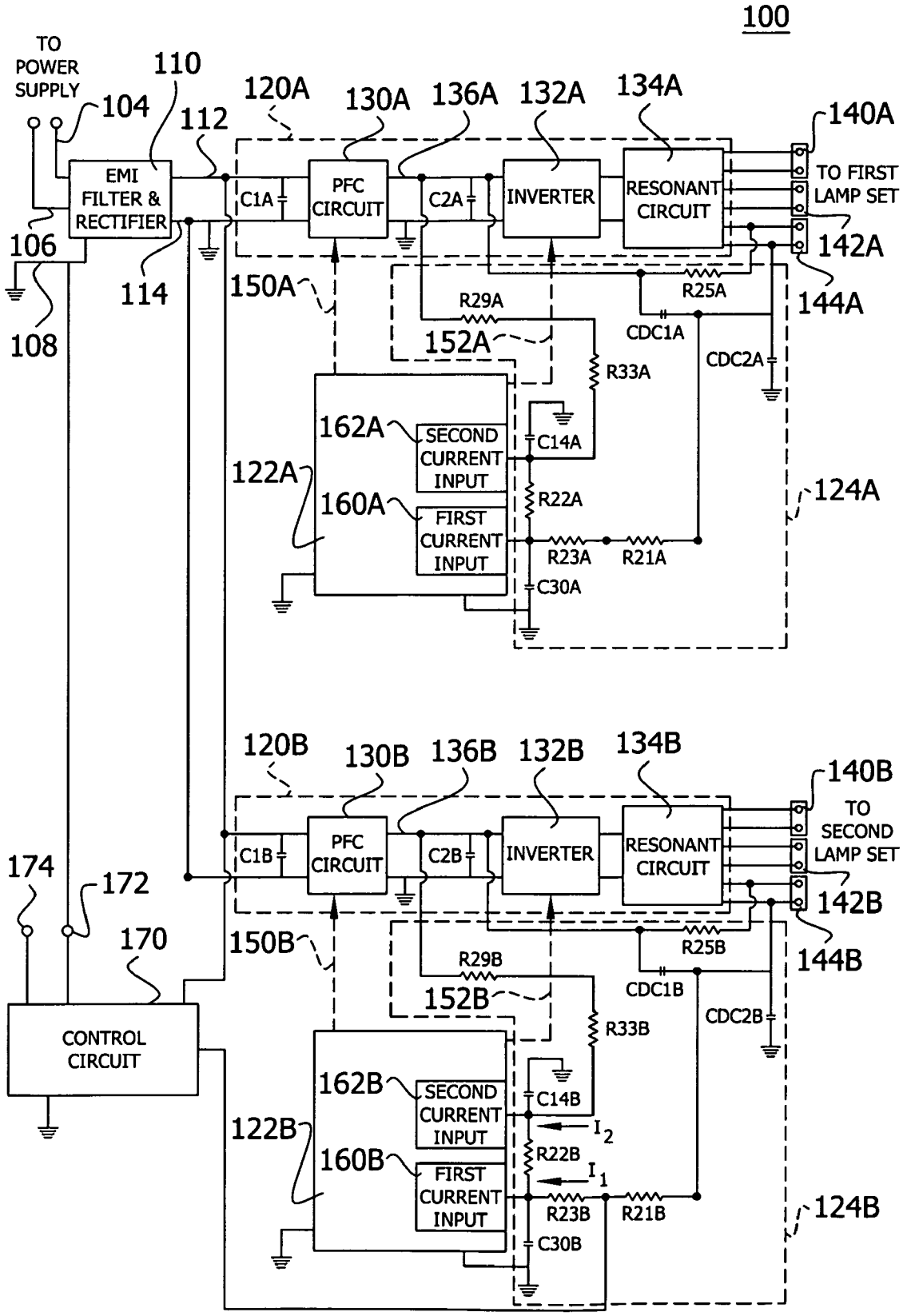
FIG. 1 is a schematic diagram, partially in block form, of an electronic ballast for powering a plurality of lamps according to one embodiment of the invention.

FIG. 1 illustrates an electronic ballast 100 (hereinafter "ballast 100") for powering a first lamp set (not shown in FIG. 1) and selectively powering a second lamp set (not shown in FIG. 1) in combination according to embodiments of the invention as described herein. The ballast 100 includes a high voltage terminal (i.e., line voltage input terminal) 104 adapted for connecting to an alternating current (AC) power supply (e.g., standard 120V AC household power). The ballast 100 also includes a neutral terminal 106, and a ground terminal 108 connectable to ground potential. The ballast 100 receives an input AC power signal from the AC power supply via the high voltage terminal 104.

The ballast 100 includes an electromagnetic interference (EMI) filter and a rectifier (e.g., full-wave rectifier) 110, which are illustrated together in FIG. 1. The EMI filter portion of the EMI filter and rectifier 110 prevents noise that may be generated by the ballast 100 from being transmitted back to the AC power supply. The rectifier portion of the EMI filter and rectifier 110 converts AC voltage received from the AC power supply to DC (direct current) voltage. The rectifier portion of the EMI filter and rectifier 110 includes a first output terminal connected to a DC bus 112 and a second output terminal connected to a ground potential at ground connection point 114. The rectifier portion of the EMI filter outputs a DC voltage on the DC bus 112.

The ballast 100 includes a first lamp driver circuit 120A, a first controller 122A, and a first filament health check circuit 124A for operating the first lamp set. Similarly, the ballast 100 includes a second lamp driver circuit 120B, a second controller 122B, and a second filament health check circuit 124B for operating the second lamp set. The first lamp driver circuit 120A, first controller 122A, and first filament health check circuit 124A each include components for operating the first lamp set which correspond, respectively, to the components discussed below of the second lamp driver circuit 120B, second controller 122B, and second filament health check circuit 124B for operating the second lamp set. Corresponding elements are indicated by corresponding reference numbers. Although not shown in the figures, embodiments contemplate that ballast 100 may include additional components for operating additional lamp sets (e.g., a third lamp driver circuit, third controller, and third filament health check circuit for operating a third lamp set; a fourth lamp driver circuit, fourth controller, and fourth filament health check circuit for operating a fourth lamp set; and so on).

The second lamp driver circuit 120B is connected to the DC bus 112 and the ground connection point 114. The second lamp driver circuit 120B receives DC power from the DC bus 112 and provides AC power for operating the second lamp set. The second lamp driver circuit 120B includes a first bus capacitor C1B, a power factor correction circuit 130B, a second bus capacitor C2B, an inverter 132B, and a resonant circuit 134B. The first bus capacitor C1B, connected between the DC bus 112 and the ground potential 114, conditions the rectified DC voltage. The power factor correction circuit 130B, which may, in some embodiments, be a boost converter, receives the conditioned, rectified DC voltage and produces a high DC voltage on a high DC voltage bus ("high DC bus") 136B. For example, the power factor correction circuit 130B may provide a voltage of around 450 volts to the high DC voltage bus 136B. The second bus capacitor C2B, which may, in some embodiments, be an electrolytic capacitor, is connected between the high DC bus 136B and ground potential 114 in a shunt configuration. The second bus capacitor C2B conditions the high DC voltage providing a low impedance source of voltage to the inverter 132B. The inverter 132B, which may, in some embodiments, be a half bridge inverter, receives the conditioned high DC voltage and converts it to AC voltage. The inverter 132B provides the AC voltage to the resonant circuit 134B. The resonant circuit 134B, which may, in some embodiments, include a resonant inductor and a resonant capacitor (not shown in FIG. 1), provides AC voltage to the second lamp set, which energizes the second lamp set.

The second lamp set may include one or more lamps. In the illustrated embodiment, the resonant circuit 134B is configured to energize up to two lamps (denoted as L1B and L2B). Each of the lamps L1B, L2B includes a first filament and a second filament, and each of the filaments includes a first terminal and a second terminal. The resonant circuit 134B includes a first output pair 140B, a second output pair 142B, and a third output pair 144B. The first output pair 140B is adapted for connecting across a first filament of the lamp L1B (i.e., to the first and second terminals of the first filament of the lamp L1B). The second output pair 142B is adapted for connecting to the second terminal of the second filament of the lamp L1B and to the first terminal of the first filament of the lamp L2B. The third output pair 144B is connected across the second filament of the lamp L2B (i.e., to the first and second terminals of the second filament of the lamp L2B). The ballast 100 also connects the first terminal of the second filament of the lamp L1B to the second terminal of the first filament of the lamp L2B.

In operation, the second controller 122B controls the operation of the second driver circuit 120B. For example, in one embodiment, the second controller 122B includes a first and second output 150B (represented together in FIG. 1) for controlling the operation of the power factor control circuit 130B. The second controller 122B provides a power signal to the power factor control circuit 130B via the first output of the first and second output 150B to control the energizing (e.g., turning on or turning off) of the power factor control circuit 130B. The second controller 122B provides a control signal to the power factor control circuit 130B via the second output of the first and second output 150B to control the voltage boosting operation of the power factor control circuit 130B. Similarly, the second controller 122B includes a third and a fourth output 152B (represented together in FIG. 1) for controlling the operation of the inverter 132B. The second controller 122B provides a power signal to the inverter 132B via the third output of the third and fourth output 152B to control the energizing (e.g., turning on or turning off) of the inverter 132B. The second controller 122B provides a control signal to the inverter 132B via the fourth output of the third and fourth output 152B to control (e.g., enable or disable) a switching operation of the inverter 132B.

In particular, during steady state operation, the second controller 122B drives a switching operation of the inverter 132B via a pulse width modulation unit (shown in FIG. 2 as element 214) of the second controller 122B to provide power to the resonant circuit 134B. The resonant circuit 134B powers the second lamp set (e.g., L1B, L2B) depending on whether or not it receives power from the inverter 132B. As discussed above, each of the lamps L1B, L2B includes a first filament and a second filament, and each of the filaments includes a first terminal and a second terminal. The second controller 122B prevents the switching operation of the inverter 132B if the second controller 122B determines, via the second filament health check circuit 124B, that the second filament of lamp L2B is not electrically conductive (i.e., is broken, not intact, or otherwise disconnected from either part of, or the entirety of, the third output pair 144B).

The second controller 122B monitors a first value corresponding to a first current $I_1$ received at a first current input 160B. The second controller 122B also monitors a second value corresponding to a second current $I_2$ received at a second current input 162B. The second controller 122B controls the operation of the second lamp driver circuit 120B as a function of comparisons of the monitored first value and the monitored second value. As seen in the electronic ballast 100 shown in FIG. 1, the second filament health check circuit 124B supplies a first current $I_1$ to the first current input 160B of the second controller 122B via a resistor R25B. The second filament health check circuit 124B is a fault detection circuit that provides the first current $I_1$ to the second controller 122B when the second filament of the lamp L2B is connected to the third output pair 144B regardless of whether the other filaments are connected to the output pairs 140B, 142B, 144B. According to the ballast 100 of FIG. 1, the second filament health check circuit 124B also includes resistors R21B and R23B. The resistor R25B is connected between the high DC bus 136B and the first terminal of the third output pair 144B. DC blocking capacitors CDC1B and CDC2B are connected between the high DC bus 136 and ground at an anode of resistor R25B for reducing the voltage provided to the third output pair 144B via resistor R25B. The second terminal of the third output pair 144B is connected to the first current input 160B of the second controller 122B via resistors R21B and R23B. Thus, the first current $I_1$ provided to the first current input 160B of the second controller 122B is at least in part representative of a DC current from the DC high bus 136B through the filament of the lamp connected to the third output pair 144B (e.g., second filament of the lamp L2).

A resistive network comprising resistors R29B, R33B, and R22B provides a reference current $I_2$ to the second current input 162B of the second controller 122B. The second controller 122B compares the first current $I_1$ to the second current $I_2$ and determines a calculated ratio of the first current to the second current ($I_1/I_2$). If the calculated ratio is less than or equal to a predetermined ratio, the second controller 122B disables the second lamp driver circuit 120B so that the second lamp set is not operated. In some embodiments, the second controller disables the second lamp driver circuit 120B by preventing the switching operation of the inverter 132B (i.e., prevents the inverter 132B from powering the resonant circuit 134B and the second lamp set). If the calculated ratio ($I_1/I_2$) is more than the predetermined ratio, the second controller 122B enables the second lamp driver 120B so that the second lamp set is operated. In some embodiments, the second controller 122B enables the second lamp driver circuit 120B by driving the switching operation of the inverter 132B to provide power to the resonant circuit 134B and the second lamp set. In some embodiments, the predetermined ratio used by the second controller 122B is ¾. The predetermined ratio, in some embodiments, may be a single, discrete value (e.g., 0.75), instead of a two (or more) discrete values compared to each other (e.g., ¾). When the second controller 122B determines that the calculated ratio transitions from below the predetermined ratio to the predetermined ratio, the second controller 122B checks the ballast 100 and the second lamp set for faults, as described above. If the second controller 122B finds no faults, the second controller 122B restarts the ballast 100.

Figure 2:
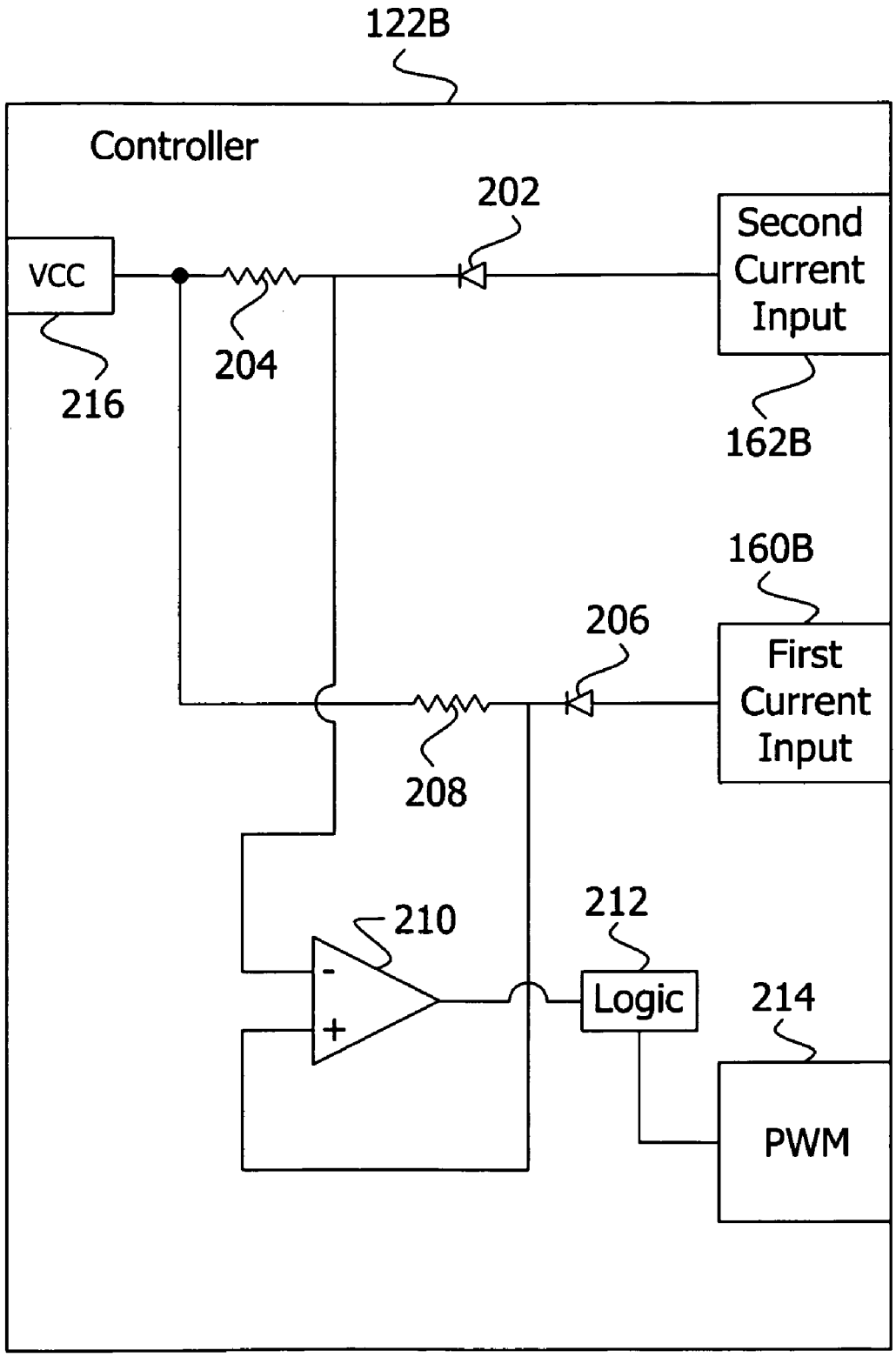
FIG. 2 is a partial schematic diagram of a controller of the electronic ballast of FIG. 1 according to one embodiment of the invention.

FIG. 2 illustrates the second controller 122B in greater detail. In some embodiments, the second controller 122B may be a controller having a model number of OS2331418 or ICB2FLOSRAM available from Infineon Technologies, AG of Neubiberg Germany. As discussed above, the second controller 122B monitors/receives the first current $I_1$ at the first current input 160B. The anode of a first controller diode 206 is connected to the first current input 160B, and the cathode of the first controller diode 206 is connected to a first side of a first controller resistor 208. A second side of the first controller resistor 208 is connected to an operating voltage node 216 of the second controller 122B. The anode of a second controller diode 202 is connected to the second current input 162B, and the cathode of the second controller diode 202 is connected to a first side of a second controller resistor 204. A second side of the second controller resistor 204 is connected to the operating voltage node 216 of the second controller 122B. In some embodiments, a capacitor (not shown in FIG. 2) may be connected between the operating voltage node 216 and a ground potential.

The second controller 122B illustrated in FIG. 2 also includes a comparator 210 having a negative input connected to the cathode of the second controller diode 202 and a positive input connected to the cathode of the first controller diode 206. An output of the comparator 210 is connected to a logic circuit 212 of the second controller 122B. The logic circuit 212 determines whether to enable or disable the second lamp driver circuit 120B (e.g., to prevent or to drive the switching operation of the inverter 132B). The logic circuit 212 loads parameters into a pulse width modulation (PWM) unit 214 of the second controller 122B for driving or preventing the switching operation of the inverter 132B, and the PWM unit 214 drives the inverter 132B as a function of the loaded parameters. When the first and second currents are supplied to the second controller 122B, the operating voltage node 216 develops an operating voltage for the second controller 122B and the controller 122B draws an operating current from the node 216, enabling start up of the ballast 100. The second controller 122B also analyzes the first current $I_1$ and the second current $I_2$ to determine faults, as described above.

Referring again to FIG. 1, in some embodiments, the ballast 100 is configured so that the second controller 122B additionally analyzes/monitors the first current $I_1$ and the second current $I_2$ to operate the second lamp driver circuit 120B according to a selected operating mode. In particular, the ballast 100 may include a control circuit 170 connected to the first current input 160B of the second controller 122B. In one embodiment, the control circuit 170 includes a first input terminal 172 connected to a ground potential and a second input terminal 174 for selectively connecting to positive potential so that a positive potential (i.e., voltage) exists between the second terminal 174 and the first terminal 172. In another embodiment, the first input terminal 172 is configured for connecting to a low positive potential and the second input terminal 174 is configured for selectively connecting to a high positive potential so that a positive potential exists between the second terminal 174 and the first terminal 172. The control circuit 170 reduces the first current $I_1$ so that the calculated ratio ($I_1/I_2$) of the first current to the second current, as determined by the second controller 122B, falls below the predetermined ratio as a function of whether a positive voltage exists between the second terminal 174 and the first terminal 172. In the ballast 100, the second input terminal 174 of the control circuit 170 is adapted for selectively connecting to a positive terminal (e.g., 104, 106) of the AC power supply. Accordingly, the control circuit 170 reduces the first current $I_1$ so that the calculated ratio ($I_1/I_2$) of the first current to the second current, as determined by the second controller 122B, falls below the predetermined ratio as a function of a connection state of the control circuit 170 to the AC power supply.

Figure 3:
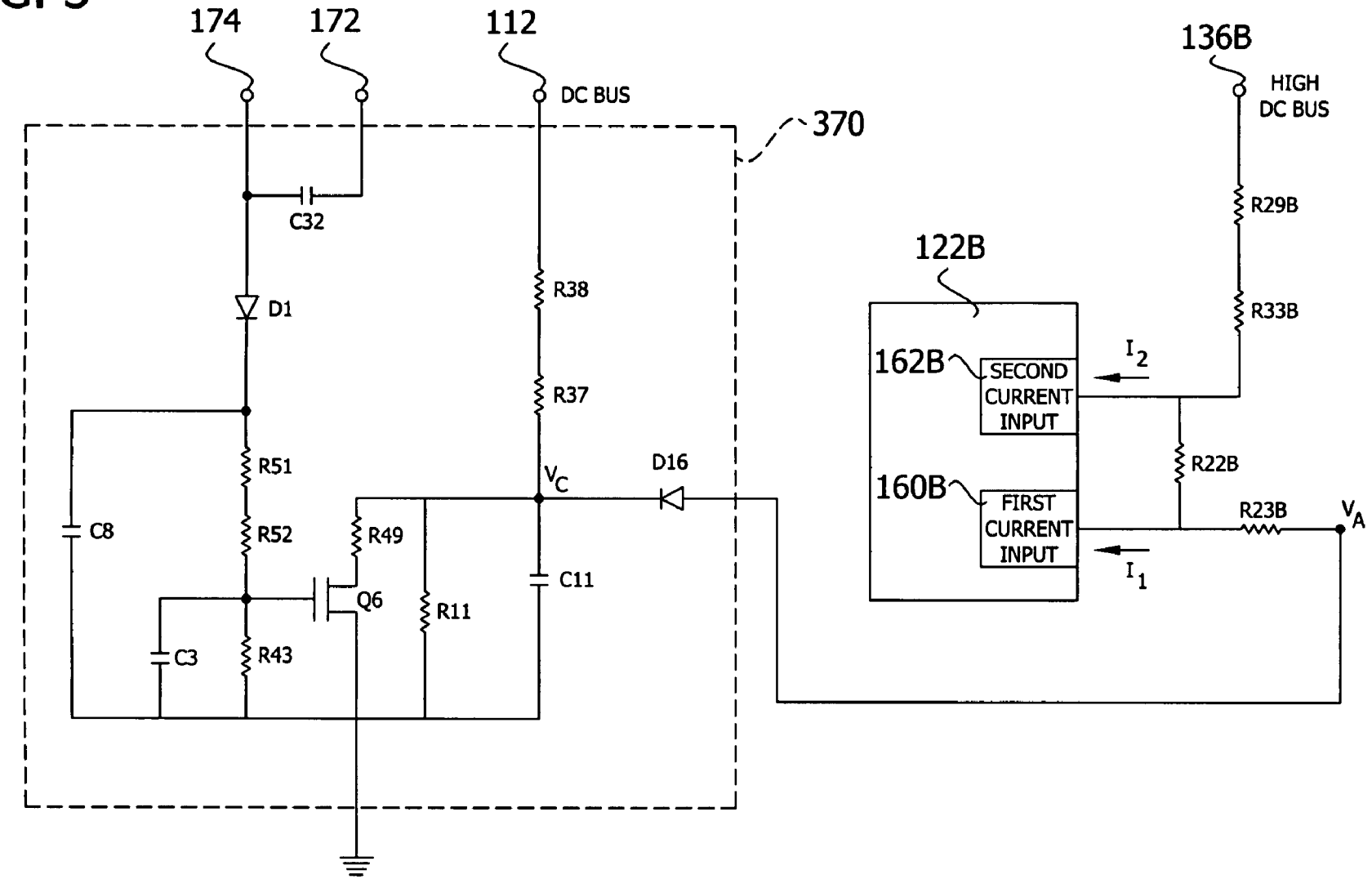
FIG. 3 is a schematic diagram of a control circuit included in the ballast of FIG. 1 according to one embodiment of the invention.
Figure 4:
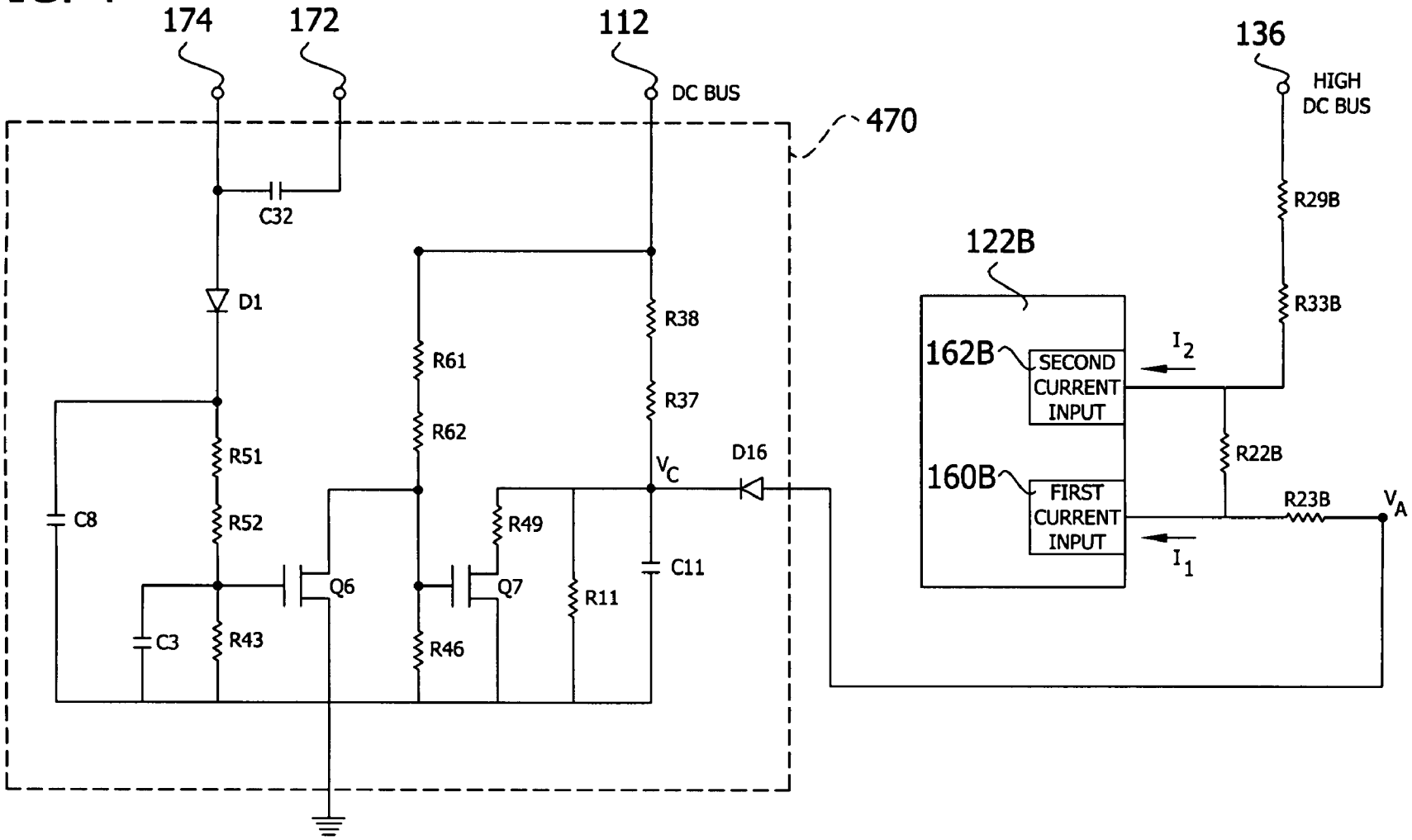
FIG. 4 is a schematic diagram of another control circuit included in the ballast of FIG. 1 according to one embodiment of the invention.

Thus, the control circuit 170 provides the ballast 100 with multilevel lighting functionality without multiple power switches and the removal of output wires that connect to the second set of lamps. More particularly, the control circuit 170 conveniently allows the ballast 100 to be selectively operated in a first operation mode or a second operation mode. In the first operation mode, both the first lamp driver circuit 120A and the second lamp driver circuit 120B are enabled, and thus both the first lamp set and the second lamp set may be energized. In the second operation mode, the first lamp driver circuit 120A is enabled and the second lamp driver circuit 120B is disabled, so that only the first lamp set may be energized. The operation mode is selected based on whether a positive or non-positive voltage exists between the second and first input terminals 174, 172 of the control circuit 170. For example, as discussed below, FIG. 3 illustrates an embodiment of a control circuit 370 for use in a ballast, such as the ballast 100 shown in FIG. 1, to operate the ballast in the first operating mode when non-positive voltage exists between the second and first input terminals 174, 172, and to operate the ballast in the second operating mode when a positive voltage exists between the second and first input terminals 174, 172. FIG. 4 illustrates an alternative embodiment of the control circuit 370 as a control circuit 470. The control circuit 470 may also be used in a ballast, such as the ballast 100 shown in FIG. 1, to operate the ballast in the first operating mode when positive voltage exists between the second and first input terminals 174, 172 and to operate the ballast in the second operating mode when a non-positive voltage exists between the second and first input terminals 174, 172.

Referring to FIG. 3, the illustrated control circuit 370 is configured to reduce the first current $I_1$. This results in the calculated ratio of the first current to the second current ($I_1/I_2$), as determined by the second controller 122B, falling below the predetermined ratio stored within the second controller 122B while a positive potential exists between the second input terminal 174 and the first input terminal 172. Accordingly, in an embodiment in which the control circuit 370 is used in the ballast 100 of FIG. 1, the second controller 122B disables the second lamp driver circuit 120B, shutting down the second lamp set, while a positive potential exists between the second input terminal 174 and the first input terminal 172 (e.g., while the second input terminal 174 is connected to the high voltage terminal 104 or the neutral terminal 106 of the power supply). On the other hand, the second controller 122B enables the second lamp driver circuit 120B, so that the second lamp set is operable, while a non-positive potential exists between the second input terminal 174 and the first input terminal 172 (e.g., while the second input terminal 174 is disconnected from the high voltage terminal 104 and the neutral terminal 106 of the power supply).

The control circuit 370 includes a first control diode D1 having an anode connected to the first and second input terminals 172, 174. A capacitor C32 is connected between the first input terminal and the anode of the first control diode D1 to prevent noise (e.g., electromagnetic interference) that may be generated by the control circuit 370 from being transmitted back to the AC power supply. A cathode of the first control diode D1 is connected via a resistive network R51, R52, R43 to a gate terminal of transistor Q6. When the second terminal 174 is connected to a positive terminal (e.g., 104, 106) of the AC power supply, a positive voltage exists at the anode of the first control diode D1. Accordingly, the first control diode D1 conducts current through the resistive network R51, R52, and R43. The resistive network R51, R52, and R43 acts as a voltage divider with the gate terminal of transistor Q6 being connected between resistors R52 and R43. Resistor R43 and a source voltage of the transistor Q6 are connected to a ground potential. Thus, the current through resistor R43 generates a voltage across the gate and source terminals of the transistor Q6. The transistor Q6 turns on while the generated gate-to-source voltage exists. The control circuit 370 includes conditioning capacitors C8 and C3 for filtering and smoothing the generated gate-to-source voltage.

The control circuit 370 is connected to the DC bus 112. A resistive network R38, R37, R49, and R11 reduces the DC voltage received from the DC bus by the control circuit 370. A capacitor C11 filters the DC voltage received from the DC bus 112 by the control circuit 370. According to the control circuit 370 as illustrated in FIG. 3, a drain terminal of the transistor Q6 is connected to the DC bus 112 via resistors R38, R37, R49. A cathode of a second control diode D16 is connected at a junction of series resistors R37, R38, and resistor R49, and resistor R11. An anode of the second control diode D16 is connected to the first current input R160B of the second controller 122B via resistor R23B. When the transistor Q6 is on, current is pulled across resistors R49 and R11 which pulls voltage $V_C$ at the cathode of the second control diode D16 below the voltage $V_A$ at the anode of the second control diode D16. When the voltage $V_A$ at the anode of the second control diode D16 is greater than the voltage $V_C$ at the cathode of the second control diode D16, the diode D16 conducts current thereby reducing the first current $I_1$ so that the calculated ratio of the first current to the second current ($I_1/I_2$), as determined by the second controller 122B, falls below the predetermined ratio stored within the second controller 122B.

On the other hand, according to the control circuit 370 as illustrated in FIG. 3, when the second terminal 174 is disconnected from the positive terminals of the AC power supply, a non-positive voltage exists at the anode of the first control diode D1. Accordingly, the first control diode D1 does not conduct current through the resistive network R51, R52, and R43 and voltage is not generated across the gate and source terminals of the transistor Q6. Thus, the transistor Q6 is turns off while the second terminal 174 is disconnected from the power supply and the voltage $V_C$ at the cathode of the second control diode D16 remains greater than the voltage $V_A$ at the anode of the second control diode D16. Since the voltage $V_A$ at the anode of the second control diode D16 is less than the voltage $V_C$ at the cathode of the second control diode D16, the second control diode D16 does not conduct current, so the first current $I_1$ is not reduced and the calculated ratio of the first current to the second current ($I_1/I_2$), as determined by the second controller 122B, is not pulled below the predetermined ratio stored within the second controller 122B.

Referring to FIG. 4, the illustrated control circuit 470 includes the components included in the control circuit 370 of FIG. 3 and additionally includes inverting components R61, R62, R46, and transistor Q7. The inverting components R61, R62, R46, Q7) invert the effect discussed above in connection with the control circuit 370 of the connection state to the AC power supply on the first current $I_1$. In particular, control circuit 470 is configured to reduce the first current $I_1$ so that the calculated ratio of the first current to the second current ($I_1/I_2$), as determined by the second controller 122B, falls below the predetermined ratio stored within the second controller 122B while a non-positive potential exists between the second input terminal 174 and the first input terminal 172. Accordingly, in an embodiment in which the control circuit 470 is used in the ballast 100, the second controller 1228 disables the second lamp driver circuit 120B, shutting down the second lamp set, while a non-positive potential exists between the second input terminal 174 and the first input terminal 172 (e.g., while the second input terminal 174 is disconnected from the high voltage terminal 104 and the neutral terminal 106 of the AC power supply). Alternatively, the second controller 1228 enables the second lamp driver circuit 1208, so that the second lamp set is operable when a positive potential exists between the second input terminal 174 and the first input terminal 172 (e.g., while the second input terminal 174 is connected to the high voltage terminal 104 or the neutral terminal 106 of the AC power supply).

As discussed in connection with the control circuit 370 illustrated in FIG. 3, when the second terminal 174 is connected to a positive terminal (e.g., 104, 106) of the AC power supply, a positive voltage exists at the anode of a first control diode D1. Accordingly, the first control diode D1 conducts current through the resistive network R51, R52, and R43 generating a voltage across the gate and source terminals of the transistor Q6. The transistor Q6 turns on while the generated gate-to-source voltage exists. The transistor Q6 is connected to the DC bus 112 via resistors R61 and R62. Resistor R46 is connected to the resistor R62 and across gate and source terminals of a transistor Q7. Accordingly, when the transistor Q6 is on, current is pulled across the resistors R61 and R62 but not across a resistor R46. Thus, no gate-to-source voltage for the transistor Q7 is generated, so the transistor Q7 is off and the voltage $V_C$ at the cathode of a second control diode D16 is not dropped below the voltage $V_A$ at the anode of the second control diode D16. Since the voltage $V_A$ at the anode of the second control diode D16 is less than the voltage $V_C$ at the cathode of the second control diode D16, the second control diode D16 does not conduct current, so the first current $I_1$ is not reduced. The calculated ratio of the first current to the second current ($I_1/I_2$), as determined by the second controller 1228, is not pulled below the predetermined ratio as stored within the second controller 122B.

Alternatively, when the second terminal 174 is disconnected from the positive terminals of the AC power supply, a non-positive voltage exists at the anode of the first control diode D1. Accordingly, the first control diode D1 does not conduct current through the resistive network including resistors R51, R52, and R43, and no voltage is generated across the gate and source terminals of the transistor Q6, so the transistor Q6 is off. While the transistor Q6 is off, current is pulled through resistors R61, R62, and R46, generating a gate-to-source voltage across the transistor Q7 to turn the transistor Q7 on. A drain terminal of the transistor Q7 is connected to the DC bus 112 via resistors R38, R37, and R49. The resistor R11 is connected across the resistor R49 and the transistor Q7 to ground potential. While the transistor Q7 is on, current from the DC bus 112 is pulled across the resistors R49 and R11, which pulls the voltage $V_C$ at the cathode of the second control diode D16 below the voltage $V_A$ at the anode of the second control diode D16. When the voltage $V_A$ at the anode of the second control diode D16 is greater than the voltage $V_C$ at the cathode of the second control diode D16, the second control diode D16 conducts current, thereby reducing the first current $I_1$ so that the calculated ratio of the first current to the second current ($I_1/I_2$), as determined by the second controller B122, falls below the predetermined ratio stored within the second controller 122B.

Figure 5:
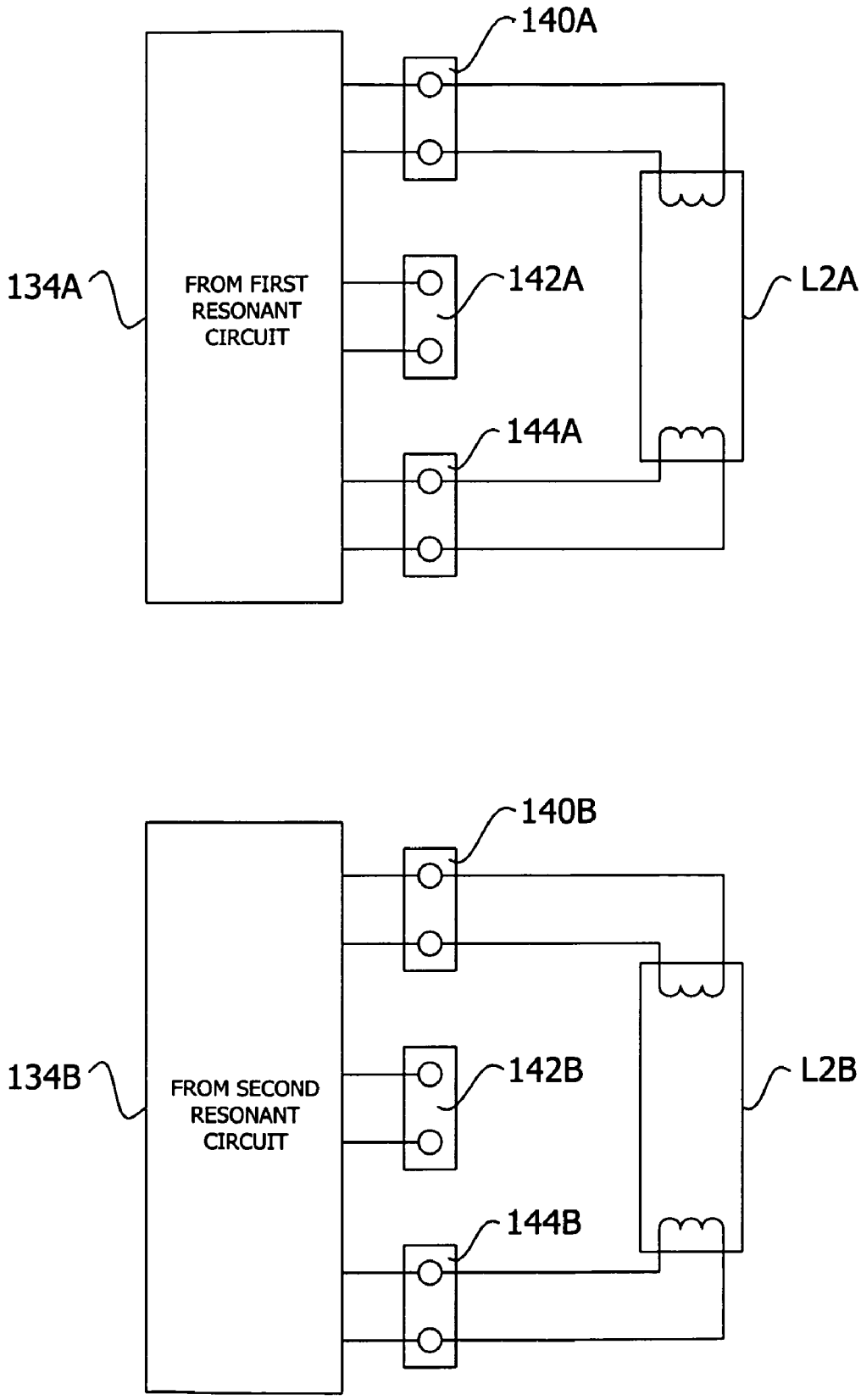
FIGS. 5-7 are wiring diagrams each illustrating a configuration for connecting the plurality of lamps to the ballast of FIG. 1 according to one embodiment of the invention.
Figure 6:
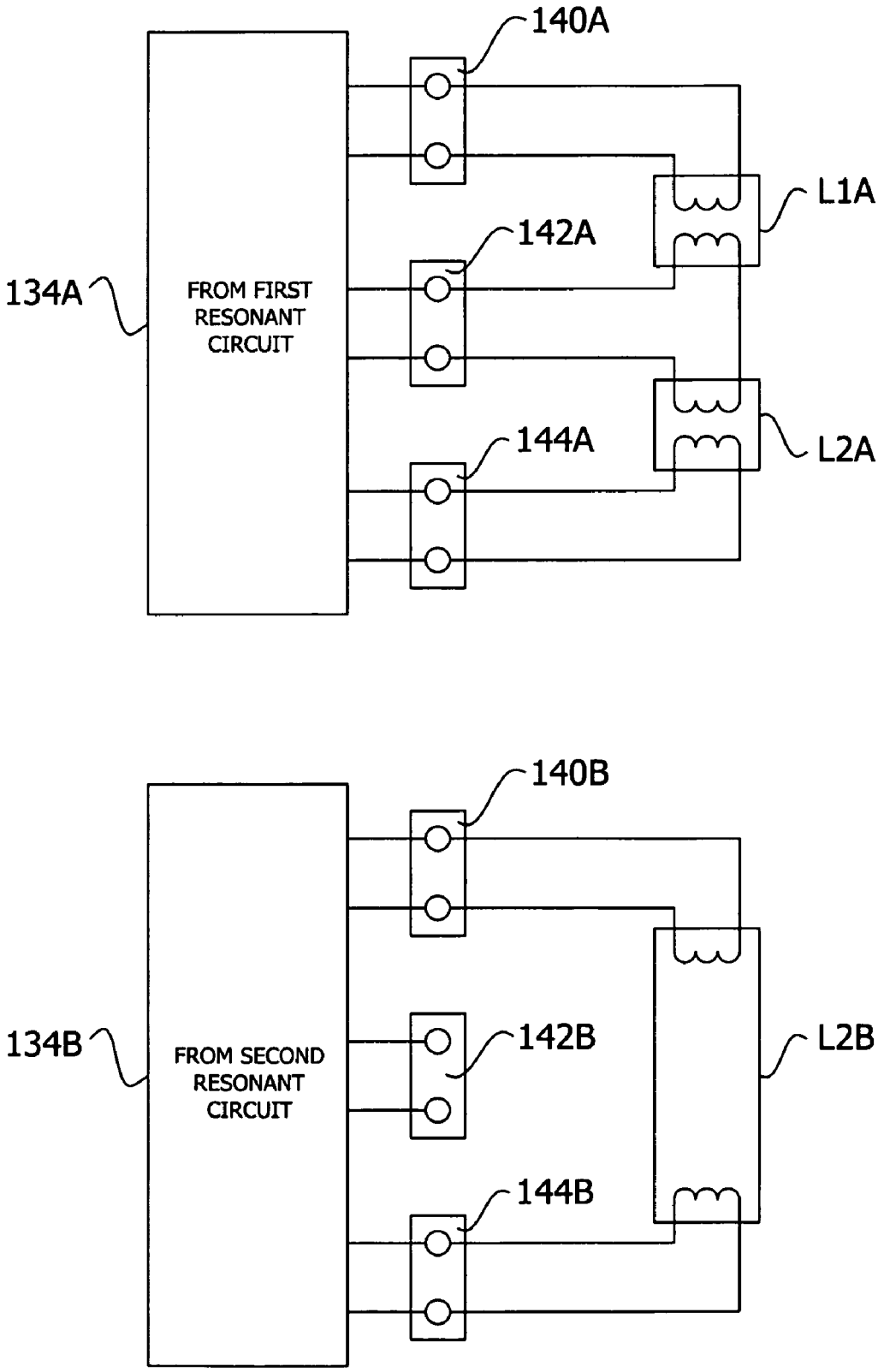
Figure 7:
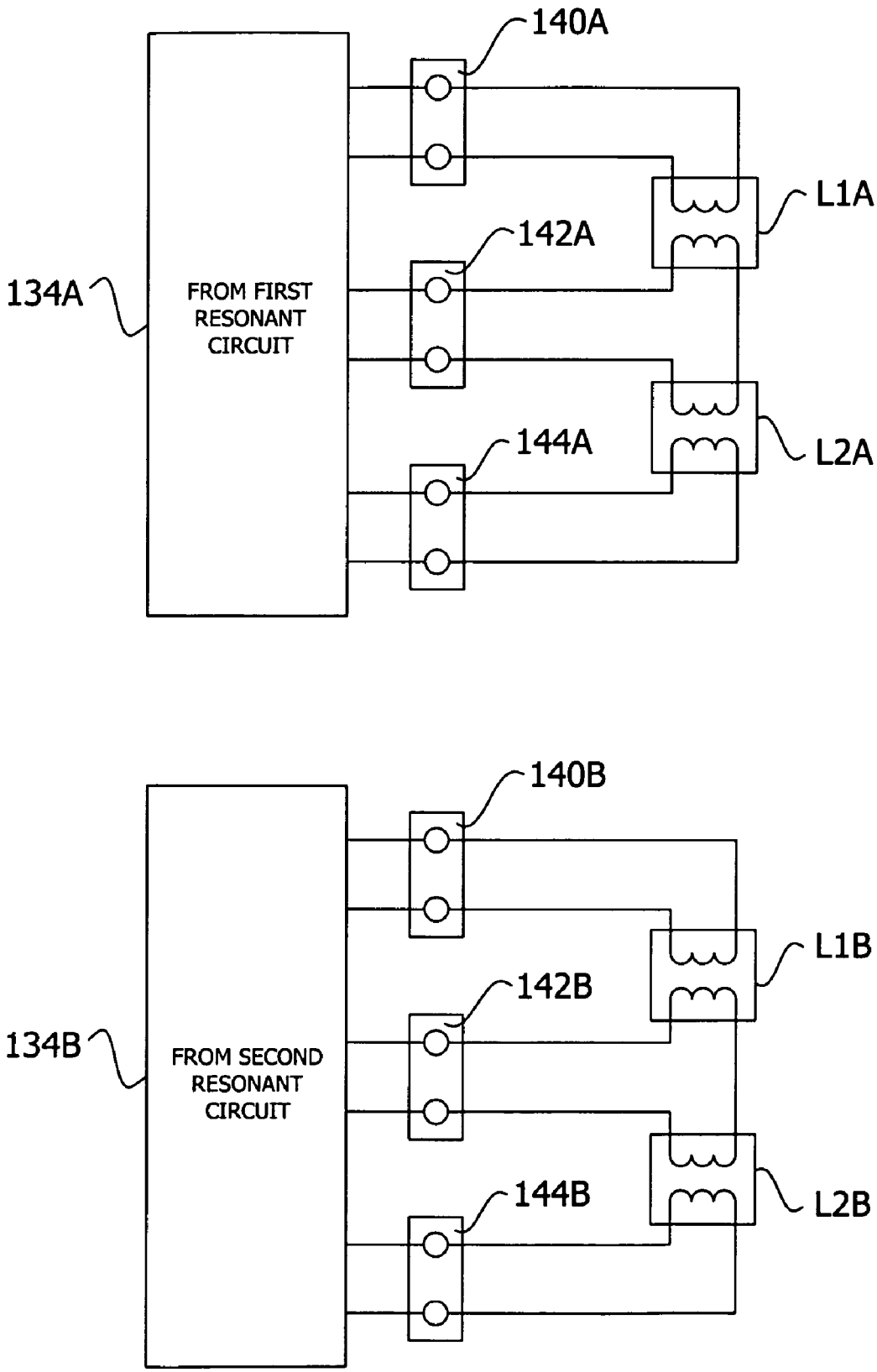

The ballast 100 as shown in FIG. 1 may be used with various different lamp sets, including various different first and second lamp sets. FIGS. 5-7 are wiring diagrams, each illustrating a configuration for connecting a first and second lamp set to the ballast 100 according to embodiments of the invention. Referring to FIG. 5, the first lamp set has one lamp L2A and the second lamp set has one lamp L2B. Thus, when the first operation mode is selected via the control circuit 170, the ballast 100 is operated so that the two lamps L2A and L2B may be energized. When the second operation mode is selected via the control circuit 170, the ballast 100 is operated so that only one lamp (in the configuration shown in FIG. 5, L2A) may be energized. Referring to FIG. 6, the first lamp set has two lamps L1A, L2A and the second lamp set has one lamp L2B. Thus, when the first operation mode is selected via the control circuit 170, the ballast 100 is operated so that the three lamps L1A, L2A, and L2B may be energized. When the second operation mode is selected via the control circuit 170, the ballast 100 is operated so that only two lamps (in the configuration shown in FIG. 6, L1A and L2A) may be energized. Referring to FIG. 7, the first lamp set has two lamps L1A, L2A and the second lamp set has two lamps L1B, L2B. Thus, when the first operation mode is selected via the control circuit 170, the ballast 100 is operated so that the four lamps L1A, L2A, L1B, and L2B may be energized. When the second operation mode is selected via the control circuit 170, the ballast 100 is operated so that only two lamps (in the configuration shown in FIG. 7, L1A and L2A) may be energized.

In some embodiments, the ballast 100 may be used with one or more sensors for selectively connecting/disconnecting the second input terminal 174 of the control circuit 170 to the AC power supply 102. For example, a sensor may be configured to sense one or more environmental parameters such as but not limited to motion, temperature, light, pressure, and/or sound. The sensor is connected between the second input terminal 174 of the control circuit 170 and a positive voltage terminal (e.g., high voltage terminal 104, neutral terminal 106) of the AC power supply. In one embodiment, the sensor may be configured to connect the second input terminal 174 of the control circuit 170 to the positive voltage terminal of the AC power supply responsive to the sensed environmental parameter and to otherwise disconnect the second input terminal 174 of the control circuit 170 from the positive terminal of the AC power supply. In another embodiment, the sensor may be configured to disconnect the second input terminal 174 of the control circuit 170 from the positive voltage terminal(s) of the AC power supply responsive to the sensed environmental parameter and to otherwise connect the second input terminal 174 of the control circuit 170 to the positive terminal of the AC power supply.

In one embodiment, the sensor may be a motion sensor used to conserve energy by disabling the second lamp driver circuit 120B, and thus the second lamp set, when no motion is detected for a predetermined amount of time. In particular, when the motion sensor detects motion, the motion sensor configures the connection state between the second input terminal 174 of the control circuit 170 and the positive terminal (e.g., 104, 106) of the AC power supply, so that the ballast 100 operates in the first operating mode. After a predetermined amount of time in which the motion sensor detects no motion, the sensor configures the connection state between the second input terminal 174 of the control circuit 170 and the positive terminal (e.g., 104, 106) of the AC power supply, so that the ballast 100 operates in the second operating mode.

In one embodiment, the components R38, R37, D16, C11, and R11 may be configured to additionally perform an accelerated reset function for the second controller 122B when the second controller 122B detects a fault, such as but not limited to a power disruption. In such a configuration, the components R38, R37, D16, C11, and R11 form a current reduction circuit. The current reduction circuit reduces the first current $I_1$ received at the first current input 160B of the second controller 122B, so that the calculated ratio ($I_1/I_2$) of the first current to the second current, as determined by the second controller 122B, drops below the predetermined ratio stored within the second controller 122B. As a result, the second controller 122B resets before a predefined fault reset period has expired.

In one embodiment, the ballast 100 optionally includes a dv/dt circuit (not illustrated). For purposes of this disclosure, the dv/dt circuit is discussed in connection with the second lamp driver circuit 120B and the second controller 122B. However, the dv/dt circuit may be used in connection with the first lamp driver 120A and first controller 122A, and/or in connection with the second lamp driver 120B and the second controller 122B. The dv/dt circuit reduces the first current $I_1$ for a transient time period in response to replacement of a lamp of the second lamp set (e.g., L1B, L2B). In operation, the dv/dt circuit monitors a voltage of the second output pair 142B connected to the second terminal of the lamp L1B for a rapid voltage change and activates a switch when a voltage change with respect to time exceeds a threshold. For example, the dv/dt circuit may activate the switch when the second filament of the lamp L1B or the first filament the lamp L2B is reconnected to the ballast 100 after a period of being disconnected, causing the first current $I_1$ to dip and the calculated ratio of the first current to the second current ($I_1/I_2$), as determined by the second controller 122B, to fall below the predetermined ratio. When the transient time period has passed, the first current $I_1$ returns, the calculated ratio of the first current to the second current ($I_1/I_2$), as determined by the second controller 122B, meets or exceeds the predetermined ratio, and the second controller 122B restarts the ballast 100 by enabling the second lamp driver circuit 120B.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

Having described aspects of the invention in detail, it will be apparent that modifications and variations are possible without departing from the scope of aspects of the invention as defined in the appended claims. As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A ballast for operating a first lamp set and for selectively operating a second lamp set in combination therewith, said ballast comprising:

a rectifier configured to receive alternating current (AC) power from a power supply and to provide a direct current (DC) voltage to a DC voltage bus;

a first lamp driver circuit and a second lamp driver circuit, each configured to receive power from the DC voltage bus and to provide AC power to operate its lamp set when said lamp driver circuit is enabled;

a controller configured to control the second lamp driver circuit, to monitor a first value corresponding to a current through a filament of a lamp in the second lamp set, to monitor a second value corresponding to a reference current, to determine a calculated ratio of the first value to the second value, and to enable the second lamp driver circuit based on the calculated ratio such that:

the controller disables the second lamp driver circuit when the calculated ratio of the first value to the second value is less than a predetermined ratio, and the controller enables the second lamp driver circuit when the calculated ratio is more than the predetermined ratio; and a control circuit comprising a first input terminal and a second input terminal, the first input terminal and the second input terminal configured to selectively connect to the power supply, the control circuit configured to reduce the current through the filament of the lamp in the second lamp set when a positive potential exists between the first input terminal and the second input terminal, such that the calculated ratio determined by the controller is less than the predetermined ratio.

2. The ballast of claim 1 wherein the second lamp driver circuit includes a boost power factor correction circuit, an inverter, and a resonant circuit, said resonant circuit comprising a resonant inductor and a resonant capacitor.

3. The ballast of claim 1 wherein the first lamp set and the second lamp set each includes a plurality of lamps.

4. The ballast of claim 1 wherein said first lamp driver circuit is enabled independently of the control circuit.

5. The ballast of claim 1 wherein the control circuit includes a diode, said diode having an anode connected to an input of the controller, the anode to receive the current through the filament of the lamp in the second lamp set from the input of the controller, said anode having a first voltage, said diode having a cathode connected to the DC voltage bus, said cathode having a second voltage, said diode conducting the DC current from the anode to the cathode while the second voltage is below the first voltage, wherein the control circuit is configured to drop the second voltage below the first voltage while a positive potential exists between the first input terminal and the second input terminal of the control circuit.

6. The ballast of claim 1 wherein the first input terminal of the control circuit is adapted for selectively connecting to a ground potential, and wherein the second input terminal is adapted for selectively connecting a positive voltage terminal of the power supply so that a positive potential exists between the first and second input terminals.

7. The ballast of claim 6, wherein said ballast is used with a sensor for sensing an environmental parameter, said sensor connected between the second input terminal of the control circuit and the positive voltage terminal of the power supply, wherein said sensor connects the second input terminal of the control circuit to the positive voltage terminal of the power supply responsive to the sensed environmental parameter, and wherein said sensor otherwise disconnects the second input terminal of the control circuit from the positive voltage terminal of the power supply.

8. A ballast for operating a first lamp set and for selectively operating a second lamp set in combination therewith, said ballast comprising:

a rectifier configured to receive alternating current power from a power supply and to provide a direct current (DC) voltage to a DC voltage bus;

a first lamp driver circuit and a second lamp driver circuit, each configured to receive power from the DC voltage bus and to provide AC power to operate its lamp set when said lamp driver circuit is enabled;

a controller configured to control the second lamp driver circuit, to monitor a first value corresponding to a current through a filament of a lamp in the second lamp set, to monitor a second value corresponding to a reference current, to determine a calculated ratio of the first value to the second value, and to enable the second lamp driver circuit based on the calculated ratio such that:

the controller disables the second lamp driver circuit when the calculated ratio of the first value to the second value is less than a predetermined ratio, and the controller enables the second lamp driver circuit when the calculated ratio is more than the predetermined ratio; and a control circuit comprising a first input terminal and a second input terminal, the first input terminal and the second input terminal configured to selectively connect to the power supply, the control circuit configured to reduce the current through the filament of the lamp in the second set when a non-positive potential exists between the first input terminal and the second input terminal, such that the calculated ratio determined by the controller is less than the predetermined.

9. The ballast of claim 8 wherein the second lamp driver circuit includes a boost power factor correction circuit, an inverter, and a resonant circuit, said resonant circuit comprising a resonant inductor and a resonant capacitor.

10. The ballast of claim 8 wherein the first lamp set and the second lamp set each includes a plurality of lamps.

11. The ballast of claim 8 wherein said first lamp driver circuit is enabled independently of the control circuit.

12. The ballast of claim 8 wherein the control circuit includes a diode, said diode having an anode connected to an input of the controller, the anode to receive the current through the filament of the lamp in the second lamp set from the input of the controller, said anode having a first voltage, said diode having a cathode connected to the DC voltage bus, said cathode having a second voltage, said diode conducting the DC current from the anode to the cathode while the second voltage is below the first voltage, wherein the control circuit is configured to drop the second voltage below the first voltage while a non-positive potential exists between the first input terminal and the second input terminal of the control circuit.

13. The ballast of claim 8 wherein the first input terminal of the control circuit is adapted for selectively connecting to a ground potential, and wherein the second input terminal is adapted for connecting a positive voltage terminal of the power supply so that a positive potential exists between the first and second input terminals and disconnecting from said positive voltage terminal of the power supply so that a non-positive potential exists.

14. The ballast of claim 13, wherein said ballast is used with a sensor for sensing an environmental parameter, said sensor connected between the second input terminal of the control circuit and the positive voltage terminal of the power supply, wherein said sensor disconnects the second input terminal of the control circuit from the positive voltage terminal of the power supply responsive to the sensed environmental parameter, and wherein said sensor otherwise connects the second input terminal of the control circuit to the positive voltage terminal of the power supply.

15. A method of operating a first lamp set via a first lamp driver circuit of a ballast and selectively operating, in combination therewith, a second lamp set via a second lamp driver circuit of the ballast, said method comprising:

monitoring a first value via a first input line connected to a terminal of a lamp in the second lamp set and to a control circuit, said control circuit adapted for selectively connecting to a power supply of the ballast, said first value corresponding to a direct current (DC) through the lamp in the second lamp set;

monitoring a second value via a second input line connected to the second lamp driver circuit, said second value corresponding to a reference current;

determining a calculated ratio of the first value to the second value;

controlling operation of the second lamp driver circuit based on the calculated ratio, said controlling comprising:

enabling the second lamp driver circuit to operate the second lamp set when the calculated ratio is more than a predetermined ratio; and disabling the second lamp driver circuit to prevent operation the second lamp set when the calculated ratio is less the predetermined ratio; and reducing by the control circuit the current through the lamp in the second lamp set so that the calculated ratio falls below the predetermined ratio as a function of a connection state of the control circuit to the power supply.

16. The method of claim 15 wherein said reducing comprises reducing by the control circuit the current through the lamp in the second lamp set so that the calculated ratio falls below the predetermined ratio when the control circuit is connected to a positive voltage terminal of the power supply.

17. The method of claim 15 wherein said reducing comprises reducing by the control circuit the current through the lamp in the second lamp set so that the calculated ratio falls below the predetermined ratio when the control circuit is disconnected from a positive voltage terminal of the power supply.

18. The method of claim 15 wherein the connection state of the control circuit to the power supply is responsive to a motion sensor.

* * * * *